US005238413A

United States Patent [19]

McCaffrey et al.

[11] Patent Number: 5,238,413

[45] Date of Patent: Aug. 24, 1993

[54] ELECTRICAL CONNECTOR WITH BOARD MOUNT FEATURE

[75] Inventors: Michael A. McCaffrey, Harrisburg; Earl W. McCleerey, Mechanicsburg, both of Pa.

[73] Assignee: The Whitaker Corporation, Wilmington, Del.

[21] Appl. No.: 965,125

[22] Filed: Oct. 22, 1992

[51] Int. Cl.[5] ..... H01R 9/09

[52] U.S. Cl. ..... 439/79; 439/82; 439/571

[58] Field of Search ..... 439/79-84, 439/374, 547, 555, 557, 567, 571, 572

[56] References Cited

U.S. PATENT DOCUMENTS

| | | | |
|---|---|---|---|
| 4,907,987 | 3/1990 | Douty et al. | 439/571 |
| 4,943,244 | 7/1990 | Teck et al. | 439/571 |
| 5,017,158 | 5/1991 | Liu et al. | 439/609 |
| 5,037,327 | 8/1991 | Van Woensel | 439/571 |
| 5,057,027 | 10/1991 | Yamada et al. | 439/83 |
| 5,074,807 | 12/1991 | Parmer | 439/557 |
| 5,076,804 | 12/1991 | Bertho et al. | 439/82 |
| 5,085,589 | 2/1992 | Kan | 439/567 |
| 5,129,831 | 7/1992 | Locati | 439/79 |
| 5,129,832 | 7/1992 | Marsh et al. | 439/79 |
| 5,129,838 | 7/1992 | Bendorf et al. | 439/372 |
| 5,184,963 | 2/1993 | Ishikawa | 439/79 |

FOREIGN PATENT DOCUMENTS

| | | |
|---|---|---|
| 0366964 | 5/1990 | European Pat. Off. . |
| 0482669A2 | 4/1992 | European Pat. Off. . |

*Primary Examiner*—Paula A. Bradley

[57] ABSTRACT

An electrical connector (1), comprising: an insulative housing (2), a board mount (7) comprising, a post (19) to interfit with an aperture (10) of a circuit board (8), a first flange (25) to engage the circuit board (8), and a second flange (26) extending over an axis of the post (19) to receive an insertion force for inserting the post (19) into the aperture (10).

9 Claims, 7 Drawing Sheets

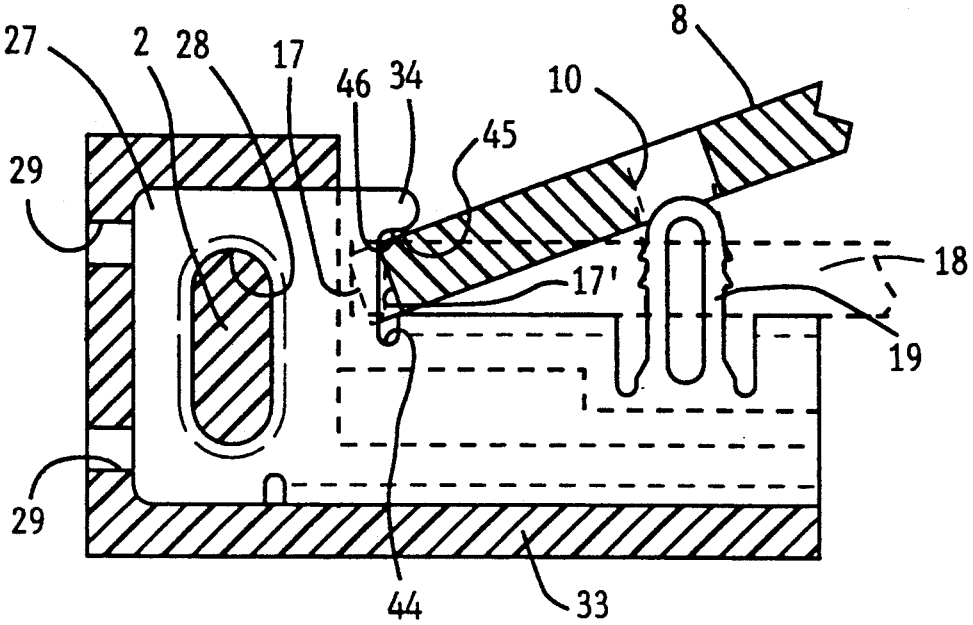
Fig.11
Fig.12
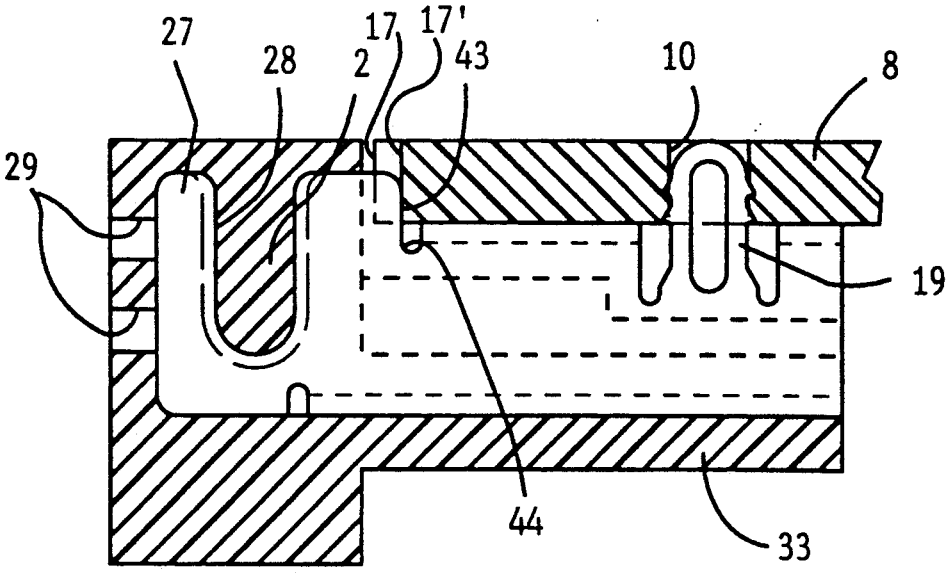

ELECTRICAL CONNECTOR WITH BOARD MOUNT FEATURE

FIELD OF THE INVENTION

The invention relates to a board mount for mounting an electrical connector to a circuit board, and to an electrical connector having such a board mount.

BACKGROUND OF THE INVENTION

A known board mount disclosed in U.S. Pat. No. 4,907,987, is fabricated from a metal stamping and comprises; a metal board lock formed with a slotted post defined by two barbed spring members extending along opposite sides of a slot having closed ends that join the spring members. A known electrical connector disclosed in U.S. Pat. No. 4,907,987, comprises; an insulative housing, multiple electrical contacts within the housing projecting toward a mating end of the connector, and a board mount comprising, a metal board lock assembled in an aperture of the housing, the board lock being comprised of a slotted post for insertion in an aperture of a circuit board. An assembly is constructed by stacking the housing on the circuit board. In the assembly, the housing has a construction that determines the depth of insertion of the post in the aperture, and the housing receives an insertion force that is applied to insert the post. Such an assembly is relatively tall in height, due to the height of the housing being added to a thickness of the circuit board. The assembly can be reduced in height by mounting the housing within a plane of thickness of the circuit board. To do so would require the board lock itself to have a construction that determines the depth of insertion of the post, and a construction that receives the insertion force, the force required to insert the post.

SUMMARY OF THE INVENTION

The invention pertains to a board mount for mounting an electrical connector to a circuit board, the board mount comprising a metal board lock formed from a metal stamping with a first flange for engaging a circuit board, a post extending from the first flange for insertion in an aperture of a circuit board, and a second flange extending over the axis of the post and providing a force receiving surface on which an insertion force is applied to insert the post in an aperture of a circuit board.

DESCRIPTION OF THE DRAWINGS

An embodiment of the invention will now be described by way of example with reference to the drawings, in which;

FIG. 11 is a view similar to FIG. 9 illustrating an alternative board lock; and

FIG. 12 is a view similar to FIG. 9, illustrating an alternative board lock.

DETAILED DESCRIPTION

Figure 1:
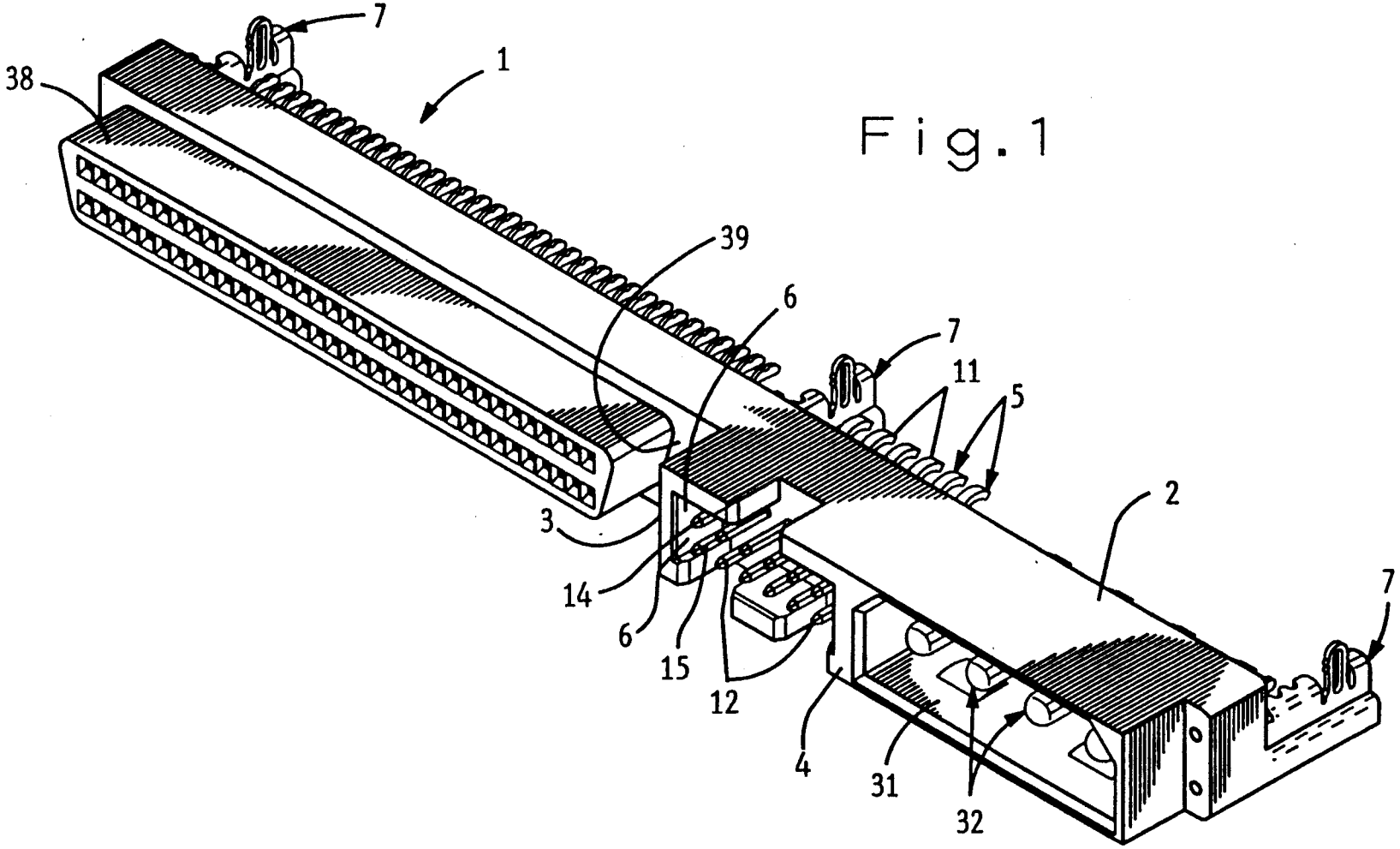
FIG. 1 is an isometric view of shrouded electrical connectors combined with an unshrouded electrical connector.
Figure 2:
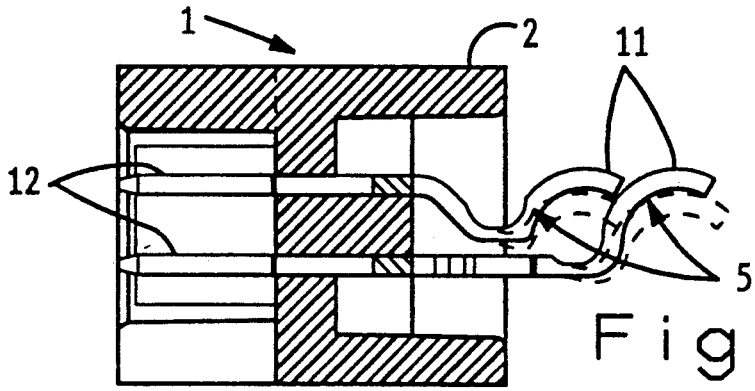
FIG. 2 is a section view taken along the line 2—2 of FIG. 6.
Figure 3:
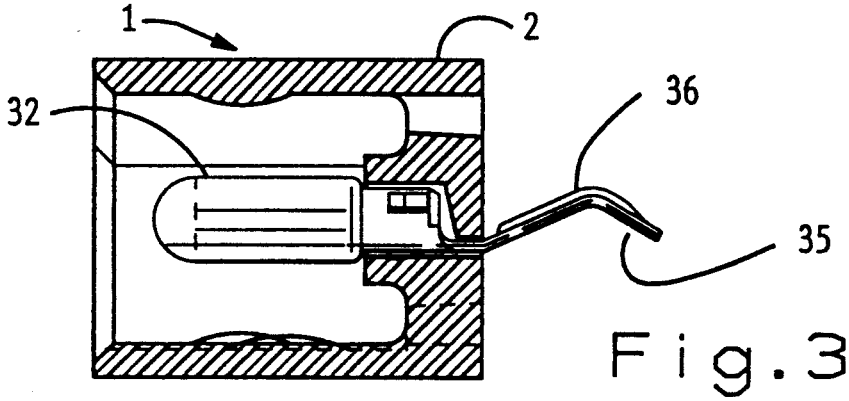
FIG. 3 is a section view taken along the line 3—3 of FIG. 6.
Figure 4:
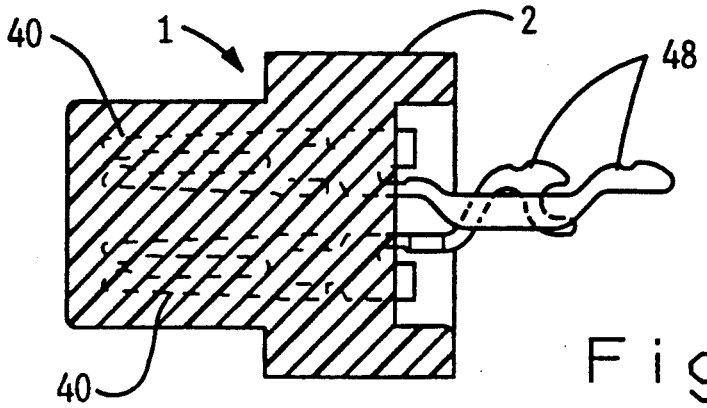
FIG. 4 is a section view taken along the line 4—4 of FIG. 6.
Figure 5:
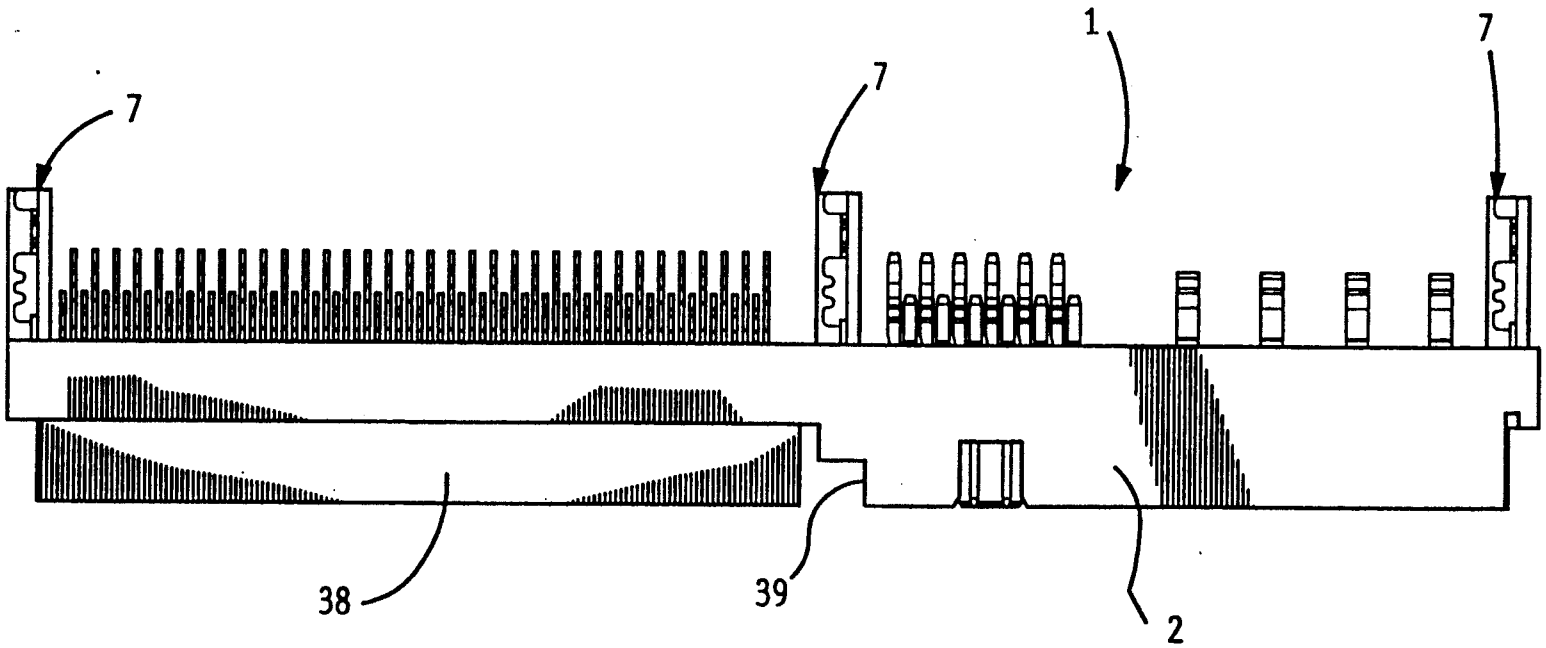
FIG. 5 is a top plan view of the connector shown in FIG. 1.
Figure 6:
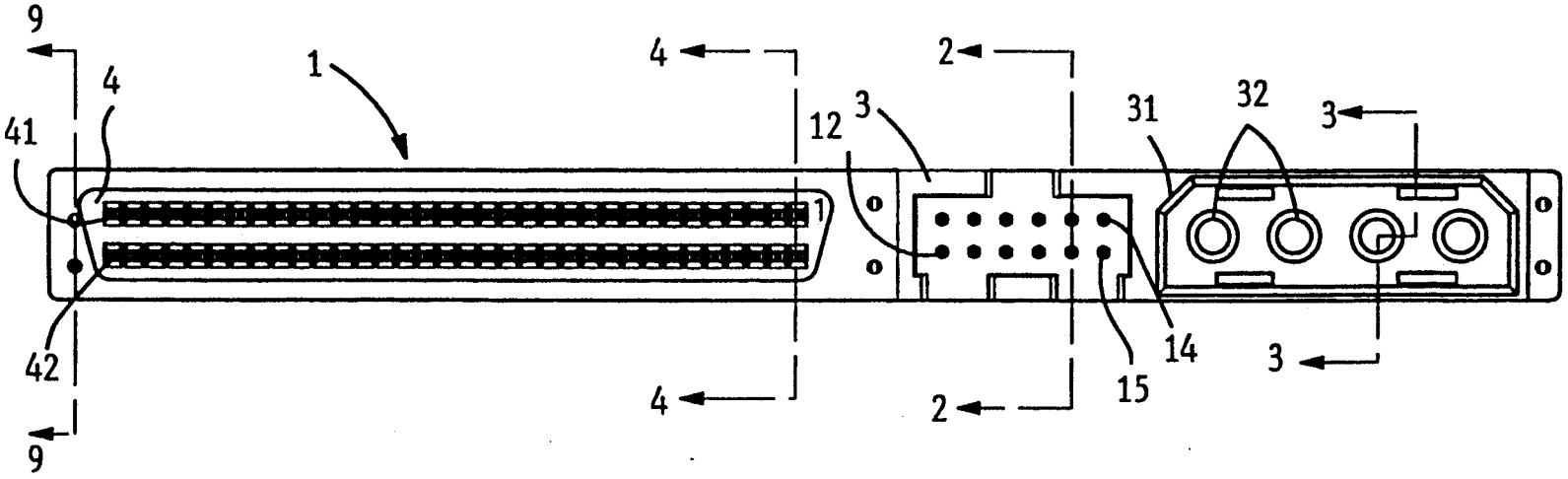
FIG. 6 is a front elevation view of the connector shown in FIG. 1.
Figure 7:
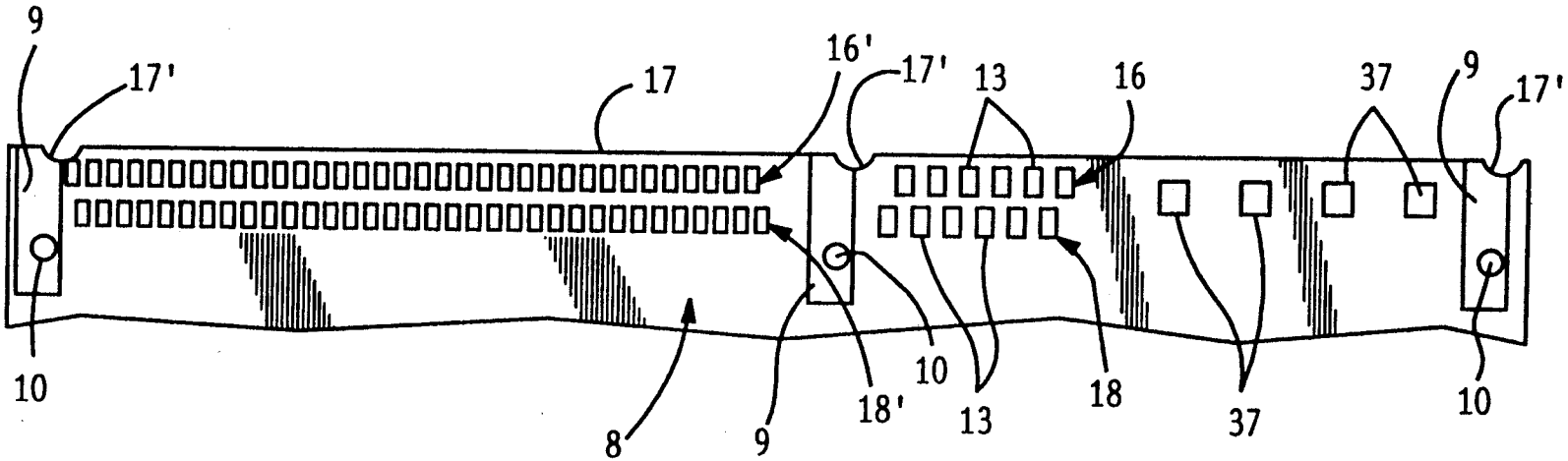
FIG. 7 is a fragmentary bottom plan view of a circuit board.

With reference to FIG. 1, an electrical connector 1 comprises, an insulative housing 2 of unitary molded plastic construction, a shroud 3 at a mating end 4 of the housing 2, and multiple, conductive electrical contacts 5, FIGS. 2 and 1, within the shroud 3 projecting toward the mating end 4. The contacts 5 are within a cavity 6 defined by the shroud 3. A board mount 7 on the housing 2 connects the housing 2 with a circuit board 8, FIG. 7. The circuit board 8 has a solder pad 9 to which the board mount 7 is to be attached by solder. An aperture 10 intersects the pad 9, and is for the purpose of receiving a post 19 of the board mount 7 with an interference fit.

With reference to FIGS. 1 and 2, a solder terminal 11 of each contact 5 projects from a rear of the housing 2. The solder terminals 11 of the contacts 5 in a top row 14 bend upward to engage a first row 16, FIG. 7, of electrically conductive pads 13 near an edge 17 of the circuit board 8. The solder terminals 11 of the contacts S in the bottom row 15, being longer than those of the contacts 5 in a top row 14, bend upward to engage a second row 18 of the pads 13 farther from the edge 17 of the circuit board 8. The solder terminal 11 of each contact 5 in the bottom row 15 is offset laterally from the centerline of the pin 12 of the same contact 5. Thereby, a solder terminal 11 of each contact 5 in the top row 14 can bend upward without engaging a solder terminal 11 of a contact 5 in the bottom row 15. The solder terminals 11 of the contacts 5 in one of the rows 14, 15 are offset laterally with respect to the solder terminals 11 of the contacts 5 in the other of the rows 14, 15.

Figure 8:
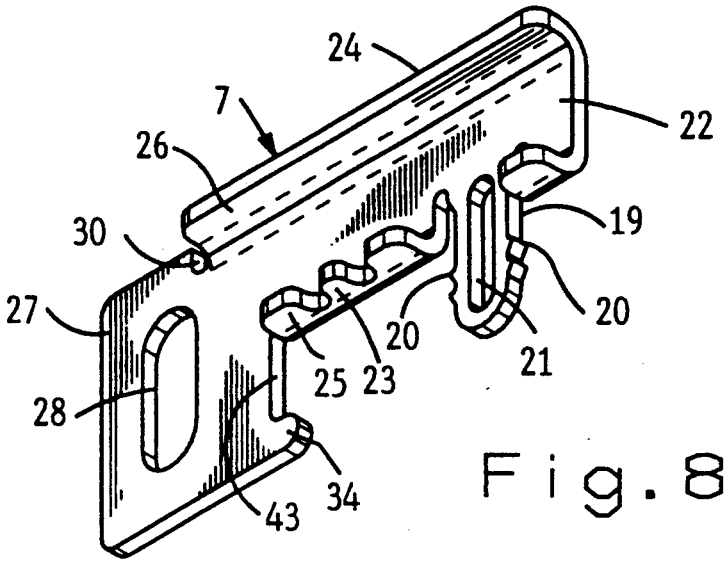
FIG. 8 is an isometric view of a board lock for the connector shown in FIG. 1.

With reference to FIG. 8, further details of an embodiment of the board mount 7 will be described. The board mount 7 is fabricated from a one piece metal stamping. A metal board lock of the board mount 7 comprises, a slotted post 19 defined by two barbed spring members 20 extending along opposite sides of a slot 21 having closed ends that join the spring members 20. The post 19 is adapted for insertion into the aperture 10 of the circuit board 8. The post 19 is dimensioned with a width having an interference fit within the aperture 10 of the circuit board 8. Further details of the post 19 and interaction with the aperture 10 is described in U.S. Pat. No. 4,907,987.

The board mount 7 further comprises, a web 22 having a first edge 23 and a second edge 24. The first edge 23 defines a periphery of both, the post 19, and a first flange 25 extending transverse to a longitudinal axis of the post 19. The post 19 projects in a plane defined by the thickness of the web 22. The first flange 25 is turned outwardly of the plane of the web 22, and is transverse to the plane of the web 22 for engaging the circuit board 8, and, more particularly, to engage one of the pads 9.

Molten solder, not shown, is used to join the first flange 25 to the pad 9. The first edge 23 along the first flange 25 has a wavy shape for amassing the molten solder, and for distributing the molten solder along the surface of the first flange 25. The second edge 24 defines a second flange 26 turned outwardly of the plane of the web 22 to extend transverse to the longitudinal axis of the post 19. The second flange 26 extends over the axis of the post 19, and provides a force receiving, pressure plate against which an insertion force is pressed to insert the post 19 with an interference fit in one of the apertures 10 of the circuit board 8.

The web 22 is contiguous with a coplanar anchor fluke 27 that extends outwardly beside the first flange 25 and the second flange 26. An opening 28 extends through the fluke 27. The housing 2 is of unitary construction, for example, by molding a polymer known as an LCP, liquid crystalline polymer. With reference to FIGS. 9 through 12, an assembly of the housing 2 and the board mount 7 can be fabricated by insert molding, such that the housing 2 is molded unitary with the board mount 7, and such that the housing 2 extends through the opening 28 in the fluke 27. In an embodiment shown in FIG. 12, the opening 28 communicates with an edge of the fluke 27. Core pin openings 29 extend through the housing 2 to intersect the fluke 27. Thereby, the fluke 27 anchors the board mount 7 to the housing 2. The web 22 and the first flange 25 and the second flange 26 and the post 19 project from a rear of the housing 2. A notch 30 at an intersection of the second flange 26 and the fluke 27 permits turning of the flange 26 outwardly.

A finger 33 on the housing 2 projects from the housing 2, and overlies the second flange 26 and a portion of the web 22 adjacent the second flange 26. The finger 33 is wider than the second flange 26, and provides a cushion against which an insertion force is applied. The cushion is particularly useful for reducing discomfort when an operator applies the insertion force by manual labor without the use of a tool to apply the insertion force. For example, the finger 33 can be fabricated unitary with the housing 2. The finger 33 partially envelops the second flange 26, adding strength to a connection of the finger 33 and the second flange 26.

Figure 9:
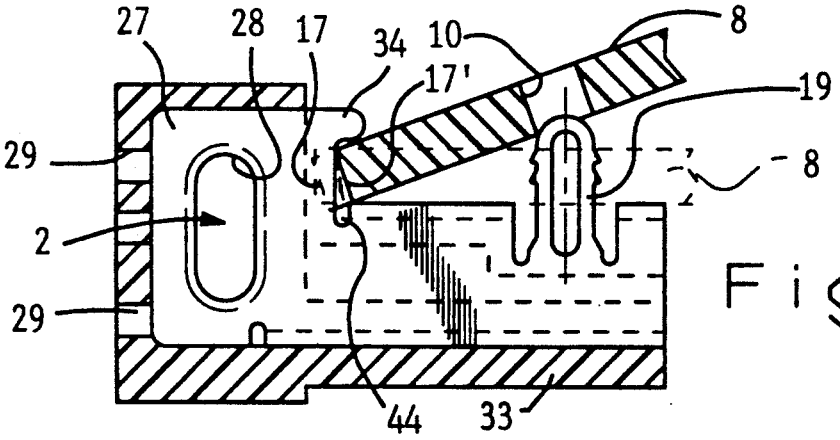
FIG. 9 is a section view taken along the line 9—9 of FIG. 6.
Figure 10:
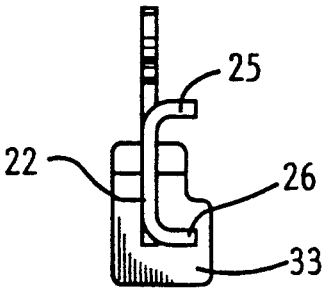
FIG. 10 is an end view of the board lock shown in FIG. 8 with parts of the housing removed to illustrate details of the board lock.

With reference to FIGS. 9 and 11, a hook 34 on the fluke 27 projects from the housing 2. A circuit board receiving space between the hook 34 and the first flange 25 is adapted to receive the edge 17 of the circuit board 8 between the hook 34 and the first flange 25. The hook 34 and the first flange 25, across the width of the space, spans a thickness of the circuit board 8. A third edge 43 along the fluke 27 extends beside the hook 34 and extends from the hook 34 to an intersection of the third edge 43 with the first edge 23. A notch 44 at the intersection separates an inner end of the first flange 25 from the third edge 43 and from the fluke 27. The third edge 43 is adapted to stop against the edge 17 of the circuit board 8, and provides a pivot. The third edge 43 registers in a rounded notch 17' in the edge 17 of the circuit board 17, and quickly locates the aperture 10 and the post 19 in mutual alignment for insertion of the post 19 into the aperture 10 when the third edge 43 is against the notch 17' in the edge 17 of the circuit board 8. When the board mount 7 is pivoted relative to the circuit board 8, and an insertion force is applied to the second flange 26, the aligned post 19 and aperture 10 are assembled with an interference fit, as shown in phantom outline in FIGS. 9, 11 and 12.

With reference to FIGS. 9 and 11, a circuit board must be positioned at an angle of elevation to pass over the post 19 and under the hook 34. In the embodiment of FIG. 11, the post 19 is taller than the post 19 in the embodiment of FIG. 10. While the taller post 19 is capable of interfitting with a circuit board 8 of relatively larger thickness than is the shorter post 19, the circuit board 8 of FIG. 11 is positioned at a relatively larger angle of elevation, particularly when the circuit board 8 of FIG. 11 is thicker than the circuit board 8 of FIG. 10.

A tip of the hook 34 in the embodiment of FIG. 11 has an undercut clearance 45 to allow for insertion of the circuit board 8, positioned at an angle of elevation, into the clearance space. A curved end 46 on the hook 19, next to the undercut clearance 45, engages the circuit board 8, particularly when the post 19 is interfit within the aperture 10, as shown in phantom outline. In an embodiment shown in FIG. 12, a hook 19 is absent. The third edge 43 provides a stop for the edge 17 of the circuit board 8. The third edge 43 can provide a pivot, although the post 19 can be interfit with the aperture 10, either by pivoting, as described with reference to FIGS. 10 and 11, or by sliding the third edge 43 along the edge of the circuit board 8.

The shroud 3 is one of multiple shrouds 3, 31 at the mating end 4 of the housing 2. The multiple shrouds 3, 31 are of different peripheral shapes and contain electrical contacts 5, 32 of different shapes. Each of the contacts 32 has a solder terminal 35 projecting from a rear of the housing 2. The solder terminal 35 is curved with a contact surface 36 for engaging one of the four solder pads 37 on the circuit board 8.

The connector 1 further may be unitary with an unshrouded connector 38 with a generally D shaped periphery at the mating end 4 of the connector 1. The unshrouded connector 38 is separated by a clearance space 39 from the shroud 3. Electrical contacts 40 within the connector 38 are arranged in two rows, a top row 41, and a bottom row 42. Each of the contacts 40 includes a solder terminal 48 projecting from a rear of the housing 2 for connection to one of multiple solder pads 37', in two rows 16', 18', on the circuit board 8.

The solder terminal 48 of each contact 40 in the bottom row 42 is offset laterally from the centerline of the receptacle 43 of the same contact 40. Thereby, a solder terminal 48 of each contact 40 in the top row 41 can bend upward without engaging a solder terminal 48 of a contact 40 in the bottom row 42. The solder terminals 48 of the contacts 40 in one row are offset laterally with respect to the solder terminals 48 of the contacts 40 in the other row.

We claim:

1. A board mount for mounting an electrical connector to a circuit board, comprising: a web having a first edge defining a periphery of a mounting post and a first flange extending transverse to a longitudinal axis of the post, the first flange being adapted for engaging a circuit board, a second edge on the web defining a second flange turned out from the plane of the web, the second flange extending transverse to the axis of the post, the second flange extending over the axis of the post and providing a force receiving pressure plate on which an insertion force is applied to insert the post in an aperture of a circuit board.

2. A board mount as recited in claim 1, and further comprising: an anchor fluke connected to the web for connection in an electrical connector to be mounted to the circuit board.

3. A board mount as recited in claim 1, and further comprising: an anchor fluke connected to the web for connection in an electrical connector to be mounted to the circuit board, an opening in the fluke, and a housing of an electrical connector being insert molded and extending through the opening.

4. A board mount as recited in claim 3, and further comprising: a finger on the housing overlies the second flange and provides a cushion against which an insertion force is applied.

5. A board mount as recited in claim 1, and further comprising: a hook facing the first flange, a clearance space between the hook and the first flange, and the hook and the first flange being adapted to span a thickness of a circuit board received by the clearance space.

6. A board mount as recited in claim 5, and further comprising: an undercut clearance space at a tip of the hook, and a curved end adjacent the undercut clearance space.

7. A board mount as recited in claim 1, and further comprising: a third edge at an intersection with the first edge and providing a stop for an edge of a circuit board, such that the post is aligned with an aperture of the circuit board.

8. A board mount as recited in claim 7, and further comprising: a notch at the intersection of the third edge and the first edge.

9. A board mount as recited in claim 7, and further comprising: said third edge for registration with notch in the edge of the circuit board.

* * * * *

UNITED STATES PATENT AND TRADEMARK OFFICE

CERTIFICATE OF CORRECTION

PATENT NO. : 5,238,413
DATED : August 24, 1993
INVENTOR(S) : McCaffrey et al.

It is certified that error appears in the above-indentified patent and that said Letters Patent is hereby corrected as shown below:

Claim 9, Column 6, line 16 add --a-- between "with" and "notch"

Signed and Sealed this

Twenty-eight Day of March, 1995

Bruce Lehman

*Attest:*

BRUCE LEHMAN

*Attesting Officer*

*Commissioner of Patents and Trademarks*